US006694483B1

(12) United States Patent
Nagata

(10) Patent No.: US 6,694,483 B1
(45) Date of Patent: Feb. 17, 2004

(54) SYSTEM FOR BACKING UP VEHICLE USE DATA LOCALLY ON A CONSTRUCTION VEHICLE

(75) Inventor: Noritaka Nagata, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/547,992

(22) Filed: Apr. 12, 2000

(30) Foreign Application Priority Data

Apr. 13, 1999 (JP) ..... 11/105384

(51) Int. Cl.[7] ..... G06F 7/00
(52) U.S. Cl. ..... 715/502; 701/1; 701/35
(58) Field of Search ..... 713/502; 701/1, 701/33, 35, 114; 364/561; 369/21

(56) References Cited

U.S. PATENT DOCUMENTS

| | | | | |
|---|---|---|---|---|
| 4,409,663 A | * 10/1983 | Becker et al. | ..... | 702/165 |
| 4,710,888 A | * 12/1987 | Burke et al. | ..... | 702/165 |
| 5,957,985 A | * 9/1999 | Wong et al. | ..... | 701/33 |
| 6,167,338 A | * 12/2000 | De Wille et al. | ..... | 701/51 |
| 6,230,082 B1 | * 5/2001 | Harada et al. | ..... | 701/1 |
| 6,356,823 B1 | * 3/2002 | Iannotti et al. | ..... | 701/35 |
| 6,389,340 B1 | * 5/2002 | Rayner | ..... | 701/35 |

FOREIGN PATENT DOCUMENTS

| | | | | |
|---|---|---|---|---|
| EP | 570138 A2 | * 11/1993 | ..... | G11B/33/02 |
| JP | 11326139 A | * 11/1999 | ..... | G01M/17/007 |
| WO | WO 9404809 A1 | * 3/1994 | ..... | F02D/45/00 |

OTHER PUBLICATIONS

IBM TDB NA920339, Removable Direct Access Storage Device Package with Shock Mount Lockouts, vol. 34, Issue 10A, Mar. 1, 1992, pp. 39–41.*

IBM TDB NN941121, Non–Mechanical Shock Proofing of Mass Storage Subsystems, vol. 37 Issue 11, Nov. 1, 1994, pp. 21–24.*

* cited by examiner

*Primary Examiner*—Thomas Lee
*Assistant Examiner*—Mark Connolly
(74) *Attorney, Agent, or Firm*—Varndell & Varndell, PLLC

(57) ABSTRACT

A data management device of a construction machine comprises a computing function for computing service meter time, a nonvolatile storage function for storing the computed data, and a transmission function for transmitting the data stored in the storage function to a monitor panel, while a monitor panel has a nonvolatile storage function for storing the data received from the data management device as backup data. With this configuration, a data management system for the construction machine which comprises the data management device and the monitor panel can reliably insure service meter time and other data even if a failure occurs to the data management device.

3 Claims, 8 Drawing Sheets

SYSTEM FOR BACKING UP VEHICLE USE DATA LOCALLY ON A CONSTRUCTION VEHICLE

BACKGROUND OF THE INVENTION

1. Field of the Invention

The present invention relates to a data management system for a construction machine which has a plurality of data management devices for collecting and managing data from a plurality of working units of the construction machine in charge of operations on traveling or work, and more particularly, to a data management system for a construction machine which can efficiently insure the service meter time and other data even if a failure occurs to the data management device of the construction machine.

2. Description of the Related Art

In order to efficiently execute maintenance management and failure diagnosis of a construction machine or working tools mounted on the construction machine, data on the operating status of the engine of the construction machine and the operating status of the working tools have been collected and managed using a computer. The integrated value of the operating time of the engine (hereafter "service meter time"), in particular, is important to estimate the life of the construction machine.

Therefore, in a conventional construction machine, an electronic device for data collection and management (hereafter "data management device") having a power supply function, computing function, timer function and display function, is disposed so that when the sensor detects the operation of the engine, this data management device executes a predetermined computing to calculate the service meter time and displays the calculated service meter time on the display.

FIG. 8 shows a conventional data management system that comprises a data processing device 81, a monitor panel 86 and a communication line 90.

The data processing device 81 is a data management system comprising a computing function 82, a storage function 83, a display function 84 and a communication function 85. The monitor panel 86 comprises a display function 88 and a communication function 89.

Conventionally, data such as service meter time that is obtained by a calculation of the computing function 82 of the data processing device 81 was stored in the storage function 83, and was displayed on the display function 84 of the data processing device 81 or on the display function 88 of the monitor panel 86. When the data such as service meter time was displayed on the display function 88 of the monitor panel 86, such data was transmitted from the communication function of the data processing device 81 via the communication line 90 to the communication function 89 of the monitor panel 86, and was displayed on the display function 88.

In the conventional management system, however, only one data processing device 81 was provided as the data management device. With the conventional construction machine, various data, including the service meter time, is centrally managed by the data management device, so if a failure occurs to the data management device, collected data is lost and the service meter time and other data can no longer be obtained.

The service meter time, in particular, is critical data for safe traveling and working, so it is a major problem when the service meter time cannot be obtained due to a simple failure of the data management device.

With the foregoing in view, it is an object of the present invention to provide a data management system for a construction machine which solves the above problems and efficiently insure the service meter time and other data even if a failure occurs to the data management device of the construction machine.

SUMMARY OF THE INVENTION

To achieve the above object, the invention is a data management system for a construction machine comprising a plurality of data management units for collecting and managing data from a plurality of working units of the construction machine in charge of operations related to traveling or work, wherein a first data management unit comprises computing means for computing data on traveling or work of an working unit in charge of traveling or work of the construction machine based on the data collected from the working unit, storage means for storing the data computed by the computing means, and transmission means for transmitting the data stored in the storage means to a second data management unit; and the second data management unit comprises storage means for storing the data received from the first data management unit as backup data.

In this way, the present invention is configured such that the first data management unit computes and stores the data on traveling or work of the predetermined working unit which is in charge of the traveling or work of the construction machine based on the data collected from the predetermined working unit, and also transmits this data to the second data management unit, and the second data management unit stores the data transmitted from the first data management unit as backup data. Therefore, even if a failure occurs to the data management device of the construction machine, the service meter time and other data can be reliably insured.

In addition, the invention can be so configured that the second data management unit further comprises return means for returning the backup data stored in the storage means to the first data management unit at a predetermined timing; and the first data management unit further comprises updating means for updating the data stored in the storage means based on the backup data returned from the second data management unit.

Still further, the invention is a data management system for a construction machine comprising a plurality of data management units for collecting and managing data from a plurality of working units of the construction machine in charge of operations related to traveling or work, wherein each one of the plurality of data management units comprises computing means for computing data on traveling or work of an working unit in charge of traveling or work of the construction machine based on the data collected from the working unit, and storage means for storing the data computed by the computing means; and at least one of the plurality of data management units further comprises judgment means for judging consistency of data which each one of the plurality of data management units stores in the storage means.

In this way, the invention is configured such that the plurality of data management units computes and stores data on the traveling or work of the predetermined working unit which is in charge of the traveling or work of the construction machine based on the data collected from the predetermined working unit, and at least one of the plurality of data management units judges the consistency of data which the plurality of data management units respectively stores. Therefore, even if a failure occurs to the data management device of the construction machine, the service meter time and other data can be reliably insured.

DESCRIPTION OF THE EMBODIMENTS

Embodiments of the present invention will now be described with reference to the accompanying drawings.

Figure 1:
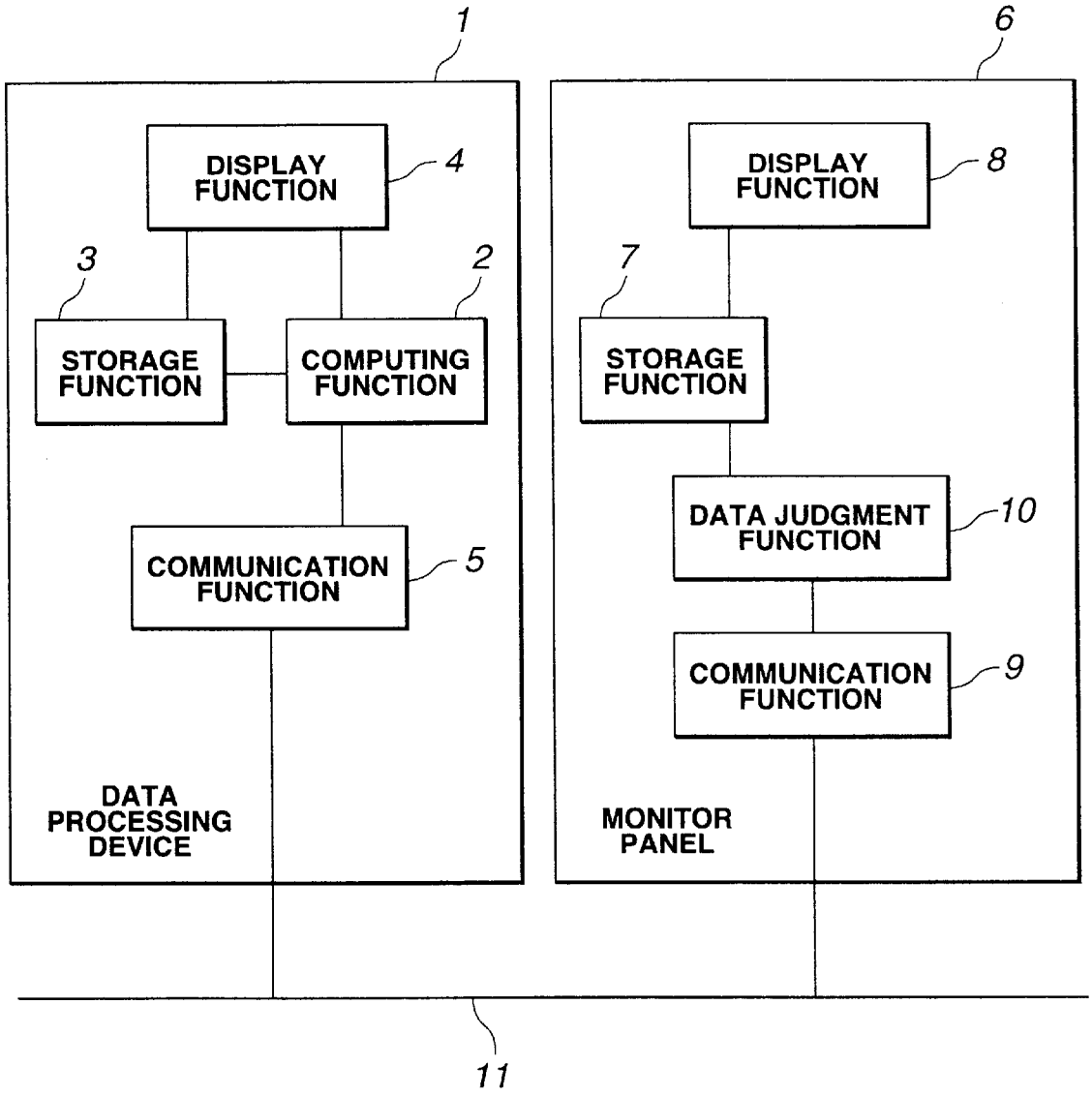
FIG. 1 is a functional block diagram depicting a configuration of the data management system for a construction machine in accordance with the first embodiment.

FIG. 1 is a functional block diagram depicting a configuration of the data management system for construction machines in accordance with the first embodiment. The data management system comprises a data processing device 1, a monitor panel 6 and a communication line 11. In this and the following embodiments, description is made in which the data processing device 1 and the monitor panel 6 serve as the data management devices in which data such as service meter time is stored. However, it is also possible that other electronic devices such as a transmission controller and a engine controller serve as the data management devices.

In this embodiment, only one-way communication, from the data processing device 1 to the monitor panel 6, is possible.

The data management system for a construction machine shown in FIG. 1 comprises a data processing device 1, a monitor panel 6 and a communication line 11. The data processing device 1 has a computing function 2, storage function 3, display function 4 and communication function 5, and the monitor panel 6 has a storage function 7, display function 8, communication function 9 and data judgment fiction 10. Such electronic device as a pump controller and engine controller, which are not illustrated, are connected to the communication line 11.

The data processing device 1 is an electronic device which centrally manages various data, including the service meter, detecting the operation of the engine by various sensors and calculating the service meter time and other data by the computing fiction 2. The storage function 3 is comprised of a nonvolatile storage device, which stores the service meter time. The display function 4 has device to display the service meter time, and the communication function 5 is an device for executing data communication and is connected to the communication line 11.

The monitor panel 6 is an electronic device performing a service meter time display fiction and a clock display function. The storage function 7 is comprised of a nonvolatile storage device, which stores the service meter time. The display function 8 has device to display the service meter time, and the communication function 9 is device for executing data communication and is connected to the communication line 11. The data judgment function 10 has a function to compare the service meter time stored in its own device and the service meter time transmitted from another electronic device and to make a judgment.

With the above described configuration, in the data management system for a construction machine, the service meter time stored in the storage function 3 of the data processing device 1 is stored in the storage function 7 of the monitor panel 6.

It is also possible to configure the data management system such that the monitor panel 6 has a service meter time computing function for integrating and storing the service meter time and transmits the data, and the data processing device 1 saves the received service meter time.

Next, the data storage procedure by the data processing device 1 and the monitor panel 6 shown in FIG. 1 will be described.

Figure 2:
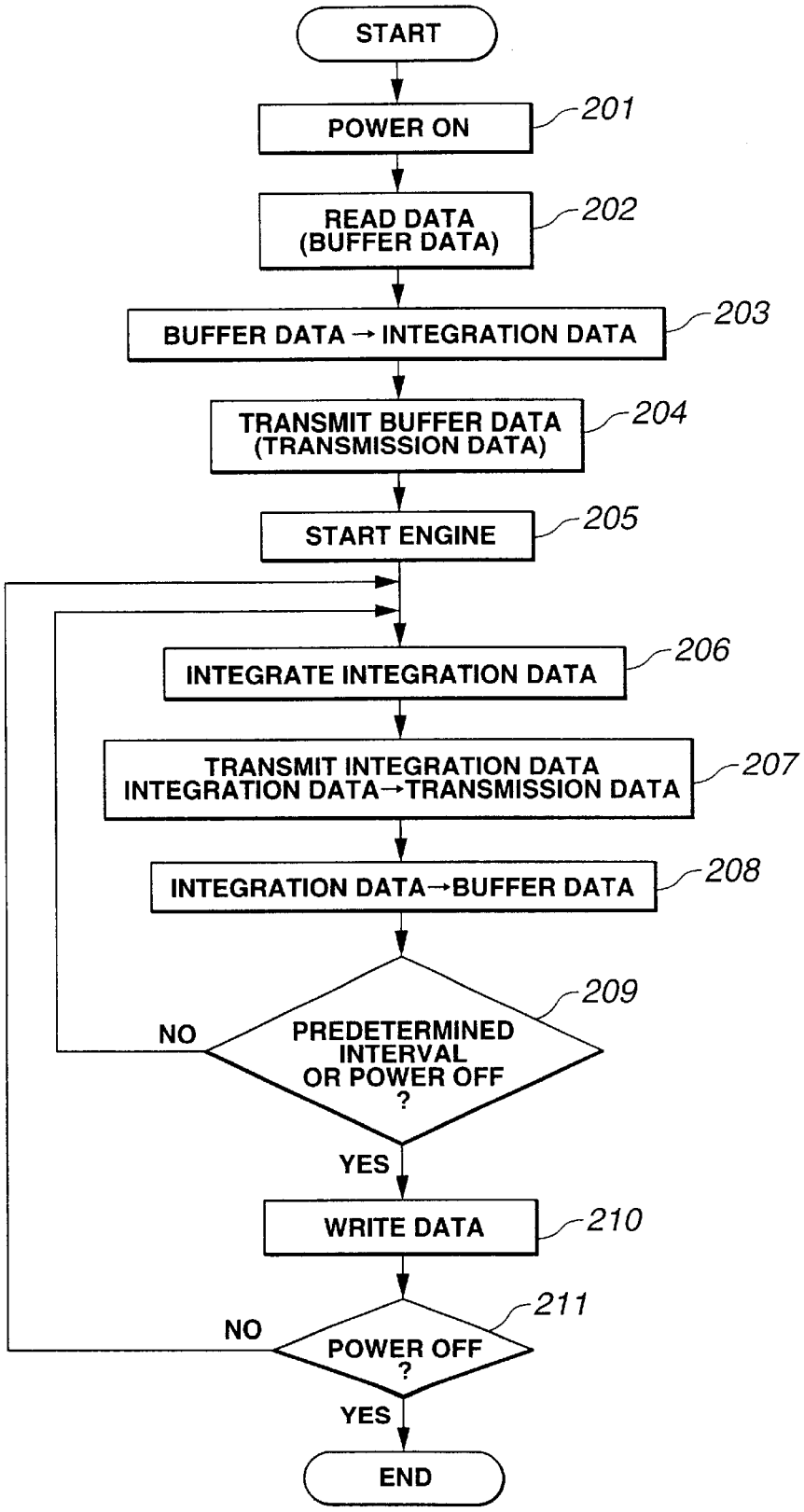
FIG. 2 is a flow chart depicting the procedure of the data processing device 1 shown in FIG. 1.

FIG. 2 is a flow chart depicting the data storage procedure in the data processing device 1 shown in FIG. 1.

As FIG. 2 shows, in the data processing device 1, the service meter time stored in the storage function 3 is read to the buffer (hereafter "buffer data") when the power switch is turned on (Steps 201–202). This buffer data becomes the initial value of the data to be integrated (hereafter "integration data") (Step 203), and is transmitted to the communication line 11 (hereafter "transmission data") (Step 204).

Then when the engine starts (Step 205) and the sensor detects the operation of the engine, the computing function 2 integrates the integration data (Step 206). At this time, this integration data is always transmitted to the communication line 11 (Step 207), and the buffer data is updated to the integration data (Step 208).

At each predetermined time or when the power switch is turned off (Step 209), the buffer data is written to the storage function 3 (Step 210). If the power switch is off at this time, processing ends, and if the power switch is not off, integration of the integration data is continued (Step 211).

Figure 3:
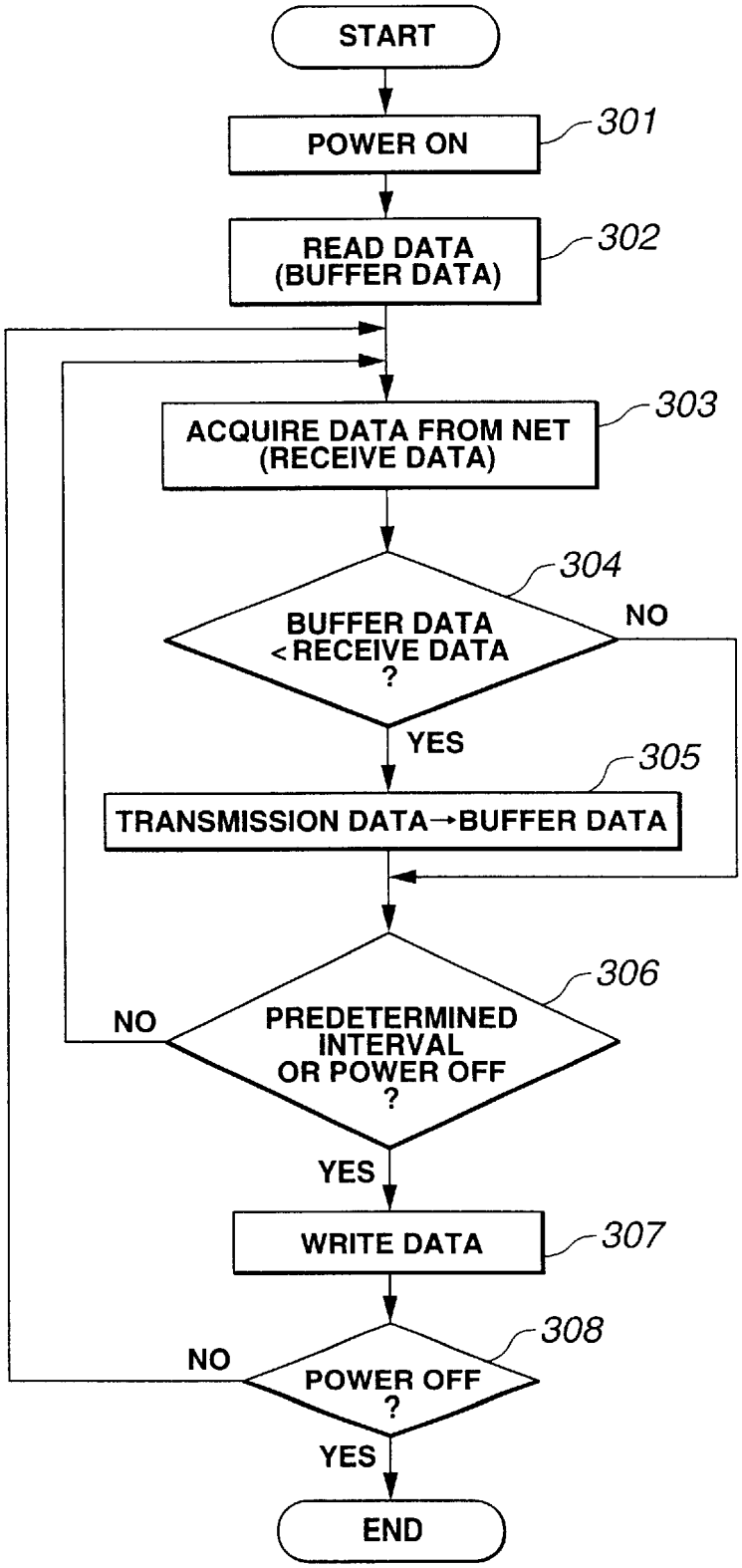
FIG. 3 is a flow chart depicting the procedure of the monitor panel 6 shown in FIG. 1.

FIG. 3 is a flow chart depicting the data storage procedure in the monitor panel 6 shown in FIG. 1.

As FIG. 3 shows, in the monitor panel 6, the service meter time stored in the storage function 7 is read to the buffer (hereafter "buffer data") when the power switch is turned on (Step 301–302).

Also the transmission data transmitted from the data processing device 1 via the communication line 11 is received (hereafter "receive data") (Step 303). Here, the sizes of the receive data and the buffer data are compared by the data judgment function 10 (Step 304), and if the size of the receive data is greater, the receive data is read to the buffer with priority (Step 305).

The buffer data is written to the storage function 7 (Step 307) at each predetermined time or when the power switch is turned off (Step 306). If the power switch is off at this time, processing ends, and if the power switch is not off, acquisition of the transmission data is continued (Step 308).

The above is the procedure for storing the service meter time to the data processing device 1 and the monitor panel 6. According to this embodiment, the service meter time of the data processing device 1 is transmitted to the monitor panel 6 and the service meter time of the monitor panel 6 is updated when the power switch is turned on.

This embodiment, however, does not have a communication means from the monitor panel 6 to the data processing device 1. So, to update the service meter time of the data processing device 1, the service meter time stored in the storage function 7 of the monitor panel 6 is displayed on the display function 8, and referring to this displayed service meter time, the service meter time of the storage function 3 to be displayed on the display function 4 of the data processing device 1 is manually advanced for updating.

Figure 4:
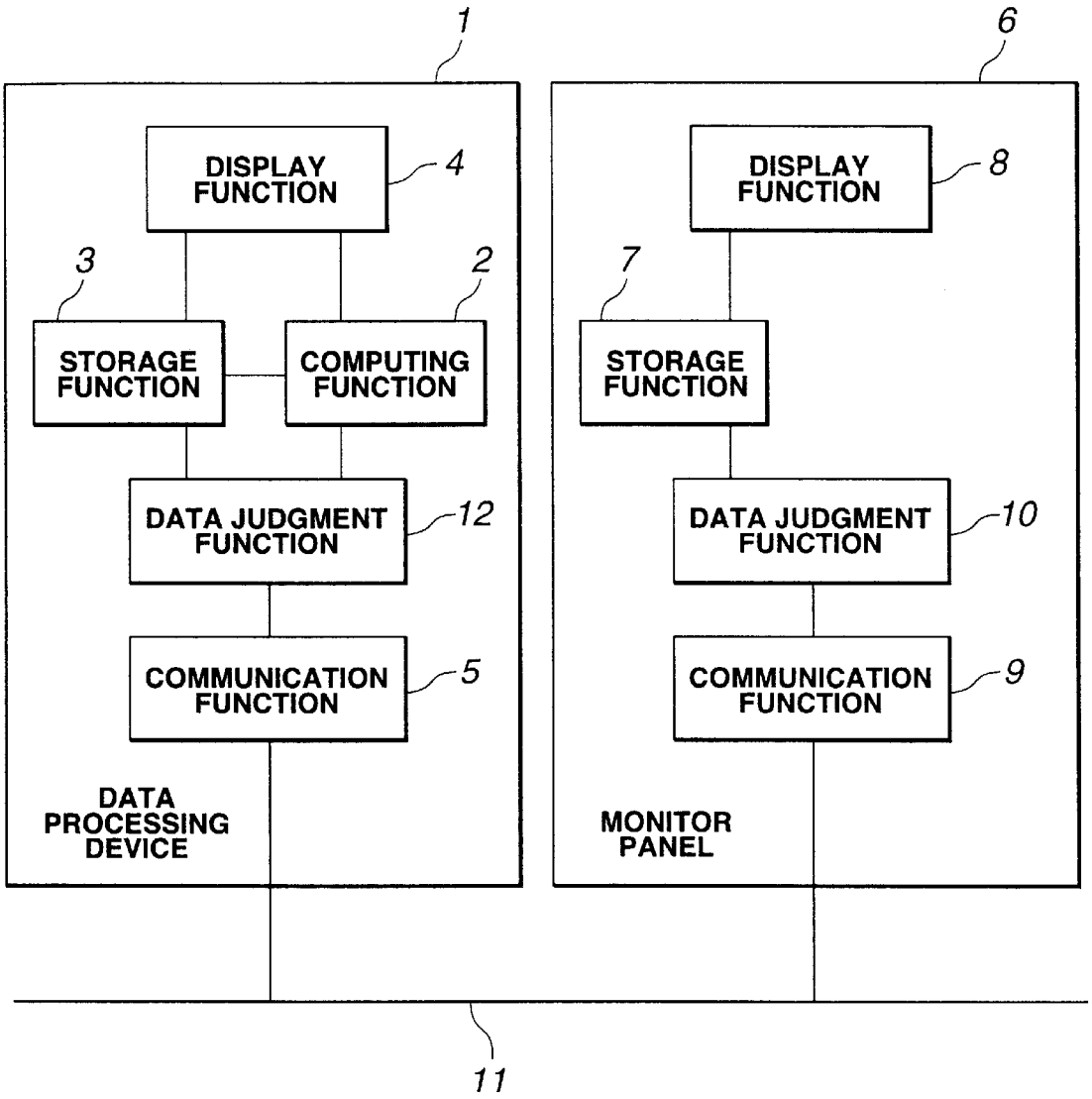
FIG. 4 is a functional block diagram depicting a configuration of the data management system for a construction machine in accordance with the second embodiment.

FIG. 4 is a functional block diagram depicting a configuration of the data management system for construction machines in accordance with the second embodiment. In this embodiment, bidirectional communication between the data processing device 1 and the monitor panel 6 is possible.

Since the basic configuration in FIG. 4 is the same as in FIG. 1, descriptions are omitted for the common parts.

This embodiment differs from the first embodiment in that bi-directional communication is possible, therefore the data processing device 1 can receive the service meter time from the monitor panel 6. At this time, if the service time transmitted from the monitor panel 6 is greater than the service meter time stored in the data processing device 1, the data processing device 1 must use the data of the monitor panel 6. Therefore, the data processing device 1, which needs a function to compare data, has the data judgment function 12. The data judgment function 12 has a function to compare the service meter time stored in its own device and the service meter time transmitted from the monitor panel 6 and to make a judgment.

In this way, this data management system for a construction machine is configured such that the service meter time stored in the storage function 3 of data processing device 1 can be stored in the storage function 7 of the monitor panel 6.

Next, the data storage procedure by the data processing device 1 and the monitor panel 6 shown in FIG. 4 will be described.

Figure 5:
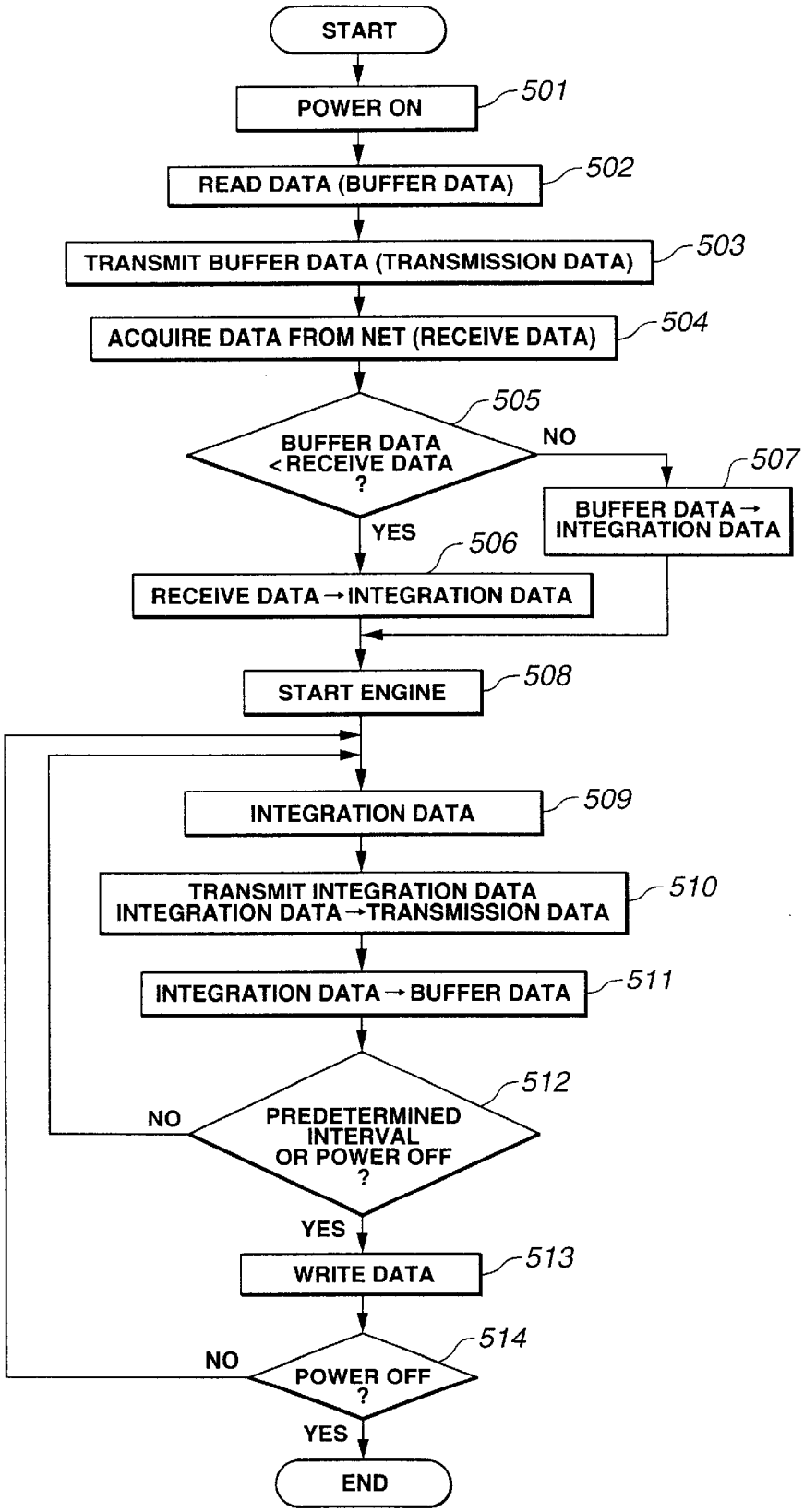
FIG. 5 is a flow chart depicting the procedure of the data processing device 1 shown in FIG. 4.

FIG. 5 is a flow chart depicting the data storage procedure in the data processing device 1 shown in FIG. 4.

As FIG. 5 shows, in the data processing device 1, the service meter time stored in the storage function 3 is read to the buffer (hereafter "buffer data") hen the power switch is turned on (Steps 501–502).

The buffer data is transmitted to the communication line 11 (hereafter "transmission data") (Step 503), and the transmission data transmitted from the monitor panel 6 via the communication line 11 is received (hereafter "receive data") (Step 504). Here, the sizes of the receive data and the buffer data are compared by the data judgment function 12 (Step 505), and the larger data is set as the initial value of the integration data (Steps 506, Step 507).

When the engine starts (Step 508) and the sensor detects the operation of the engine, the computing function 2 integrates the integration data (Step 509). At this time, this integration data is always transmitted to the communication line 11 (Step 510), and the buffer data is updated to the integration data (Step 511).

The buffer data is written to the storage function 4 (Step 513) at each predetermined time or when the power switch is turned off (Step 512). If the power switch is off at this time, processing ends, and if the power switch is not off, integration of the integration data is continued (Step 514).

Figure 6:
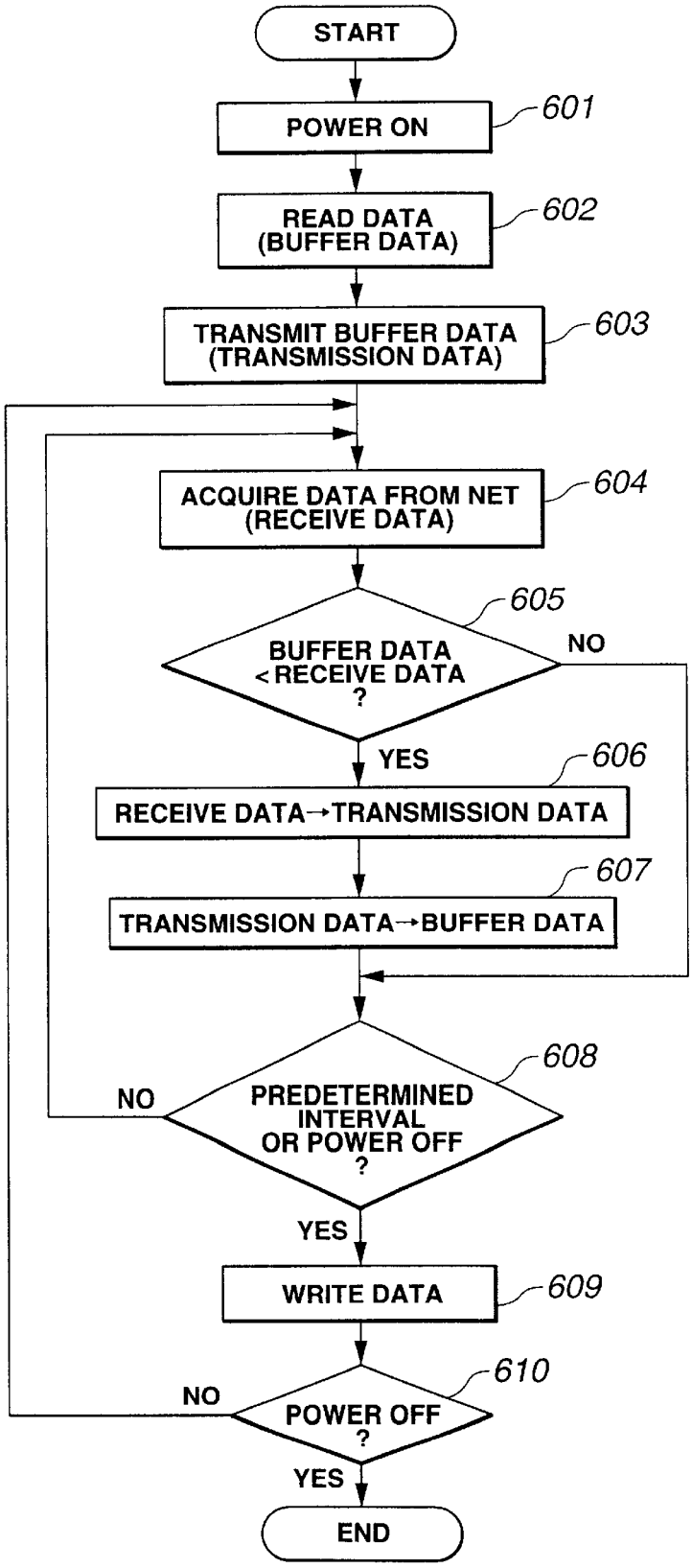
FIG. 6 is a flow chart depicting the procedure of the monitor panel 6 shown in FIG. 4.

FIG. 6 is a flow chart depicting the data storage procedure in the monitor panel 6 shown in FIG. 4.

As FIG. 6 shows, in the monitor panel 6, the service meter time stored in the storage function 7 is read into the buffer (hereafter "buffer data") when the power switch is turned on (Steps 601–602).

Also, the buffer data is transmitted to the communication line 11 (hereafter "transmission data") (Step 603), and the transmission data transmitted from the data processing device 1 via the communication line 11 is received (hereafter "receive data") (Step 604). Here, the sizes of the receive data and the buffer data are compared by the data judgment function 10 (Step 605), and if the size of the receive data is greater, the receive data is transmitted to the communication line 11 (Step 606) and is read into the buffer (Step 607).

The buffer data 2 is written to the storage function 7 (Step 609) at each predetermined time or when the power switch is turned off (Step 608). If the power switch is off at this time, processing ends, and if the power switch is not off, acquisition of the transmission data is continued (Step 610).

The above is the procedure for storing the service meter time into the data processing device 1 and the monitor panel 6. Unlike one-way communication, in the case of bidirectional communication, data can be mutually transmitted, and if the receive data is greater than the size of its own data, its own data can be updated and stored.

Figure 7:
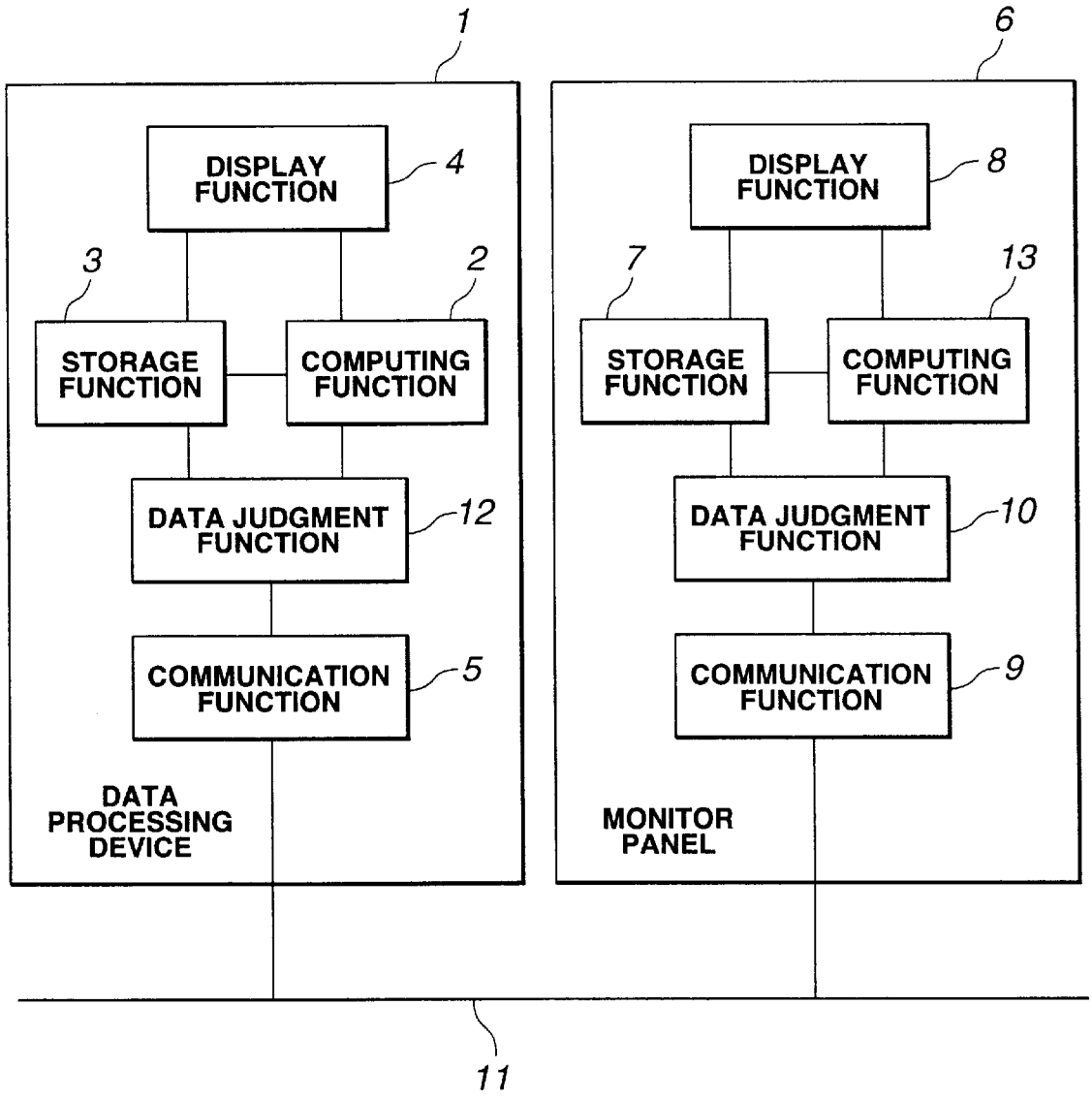
FIG. 7 is a functional block diagram depicting a configuration of the data management system for a construction machine in accordance with the third embodiment.
Figure 8:
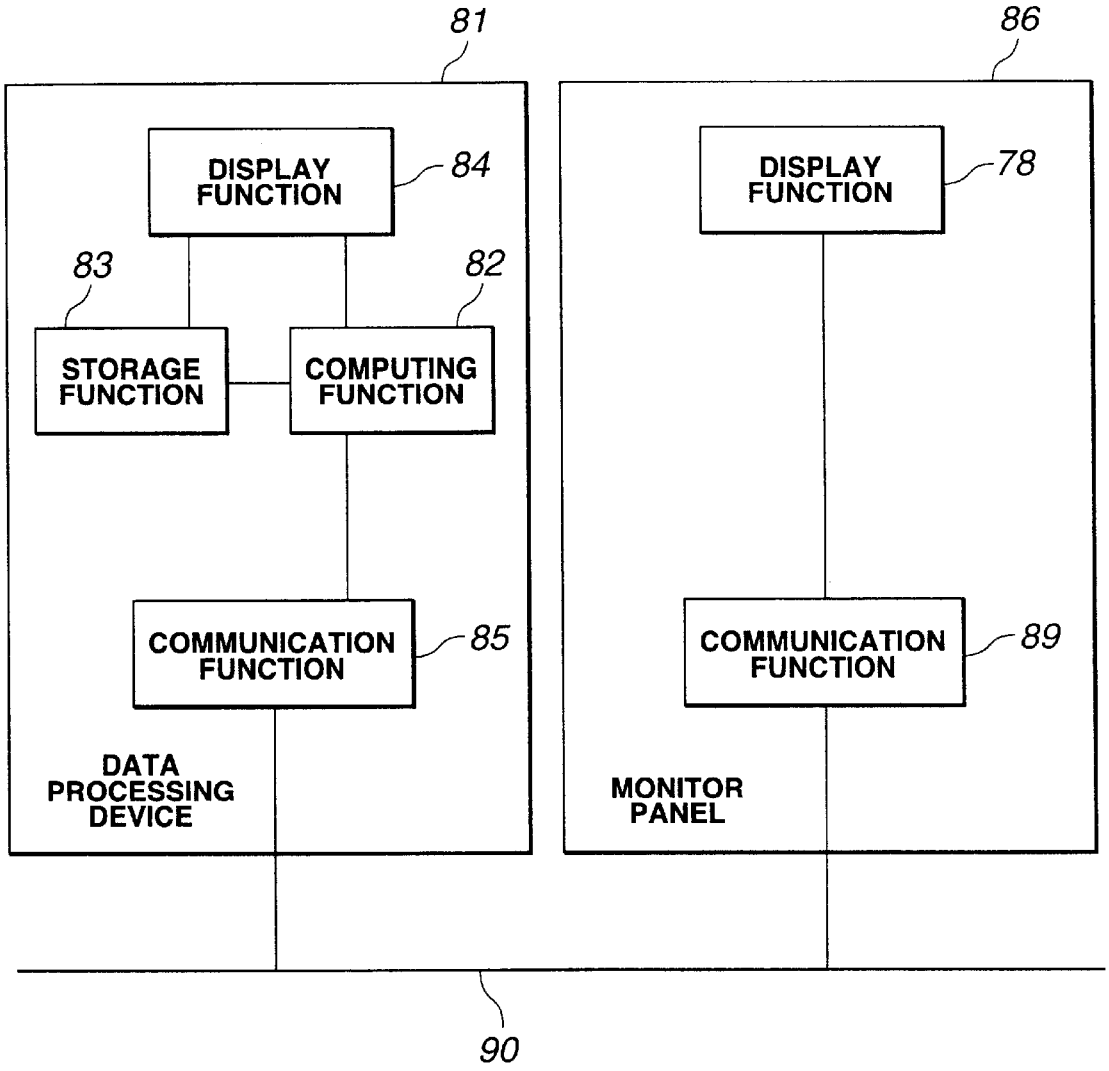
FIG.8 PRIOR ART
FIG. 8 is a functional block diagram depicting a configuration of a conventional data management system for a construction machine.

FIG. 7 is a functional block diagram depicting the configuration of the data management system for a construction machine in accordance with the third embodiment.

Since the basic configuration in FIG. 7 is the same as those in FIG. 1 and FIG. 4, descriptions are omitted for common parts.

In this embodiment, the monitor panel 6 has a computing function 13, and this computing function 13 integrates the service meter time.

Thus, the data management system of this embodiment stores the service meter time both in the storage function 3 of the data processing device 1 and in the storage function 7 of the monitor panel 6.

Next, the data storage procedure by the data processing device 1 and the monitor panel 6 shown in FIG. 7 and other electronic devices will be described.

In this case, it is possible that an error will occur to the service meter times in each electronic device, since the computing functions of the plurality of electronic device execute integration processing for the service meter time respectively. Therefore, data consistency among the electronic devices must be judged. For this judgement, the following three methods are employed.

(1) Larger signal priority (2) Main electronic device priority (3) Majority data priority (when three or more electronic devices execute data integration processing)

(1) is the processing as shown in FIG. 5.

(2) concerns that an electronic device storing the service meter time with the highest accuracy is regarded as the main electronic device, and the service meter time stored in this device is used for each of the electronic devices. When this main electronic device is replaced with a new device, however, the service meter time of the main electronic device starts with "0", which is clearly smaller than the service meter time of other electronic device. Only in such a case is the service meter time of other electronic device used.

(3) concerns that service meter time which the majority of electronic devices equally indicates is regarded as normal and is used regardless of the fact that the integration of the service meter time of minority electronic devices among the plurality of electronic device is correct or incorrect.

Now, the procedure for the above (2) and (3) will be described. Since the major procedures are the same as in FIG. 5, which depicts (1), and the only different processing is the initial value acquisition processing (Steps 505–507) before integrating data, only this part will be described and descriptions on processing which are the same as in FIG. 5 will be omitted.

In (2), if the absolute value of the difference between the buffer data, which is the service meter time stored in the storage function 3 of the data processing device 1, and the receive data, which is the transmitted service meter time, is greater than a predetermined value (a small value), the service meter time stored in the data processing device 1 is regarded as unreliable, and the receive data is used as the initial value of the integration data, otherwise the service meter time stored in the data processing device 1 is regarded as reliable, and the buffer data is used as the initial value of the integration data. Then, integration processing is executed after the engine is started.

If the absolute value of the difference between the buffer data, which is the service meter time stored in the storage function 7 of the monitor panel 6, and the receive data, which is the transmitted service meter time, is greater than a predetermined value (a small value), the service meter time stored in the electronic device for data processing device 1 is regarded as unreliable, and the buffer data is used as the integration data, otherwise the data stored in the electronic device for data processing device 1 is regarded as reliable, and the receive data is used as the initial value of the integration data. Then, integration processing is executed after the engine is started.

In (3), a majority value is selected from the buffer data, which is the service meter time stored in the storage function of the respective electronic device, and from the receive data, which is the service meter time transmitted from the respective electronic device, and the selected value is used as the initial value of the integration value. Then, integration processing is executed after the engine is started, in accordance with the third embodiment a conventional In this way, data redundancy can be provided by storing the service meter time in a plurality of the data management devices, so the service meter time and other data can be reliably insured even if a failure occurs to some of the data management devices of the construction machine.

What is claimed is:

1. A data management system for a construction machine comprising a plurality of data management units for collecting and managing data from a plurality of working units in charge of operations related to traveling or work of the construction machine, the data management units being provided in the construction machine, wherein a first data management unit comprises:

computing means for computing data on traveling or work of a working unit in charge of the traveling or work of the construction machine based on the data collected from the working unit;

storage means for storing the data computed by the computing means; and transmission means for transmitting the data stored in the storage means to a second data management unit, and the second data management unit comprises storage means for storing the data received from the first data management unit as backup data.

2. The data management system for a construction machine according to claim 1, wherein the second data management unit further comprises return means for returning the backup data stored in the storage means to the first data management unit at a predetermined timing, and the first data management unit further comprises updating means for updating the data stored in the storage means based on the backup data returned from the second data management unit.

3. A data management system for a construction machine comprising a plurality of data management units for collecting and managing data from a plurality of working units in charge of operations related to traveling or work of the construction machine, wherein each one of the plurality of data management units comprises:

computing means for computing data on traveling or work of an working unit in charge of traveling or work of the construction machine based on the data collected from the working unit; and storage means for storing the data computed by the computing means, and at least one of the plurality of data management units further comprises judgment means for judging consistency of data which each one of the plurality of data management units stores in the storage means.

* * * * *